US008650898B2

(12) United States Patent
Ma et al.

(10) Patent No.: US 8,650,898 B2
(45) Date of Patent: Feb. 18, 2014

(54) AIR CONDITIONER

(75) Inventors: Yansong Ma, Xi'an (CN); Yizhou Fan, Xi'an (CN); Haifang Ge, Xi'an (CN); Na Yan, Xi'an (CN); Liangyin Ding, Xi'an (CN)

(73) Assignee: Emerson Network Power Co., Ltd., Shenzhen, Guangdong (CN)

( * ) Notice: Subject to any disclaimer, the term of this patent is extended or adjusted under 35 U.S.C. 154(b) by 0 days.

(21) Appl. No.: 13/201,134

(22) PCT Filed: Feb. 9, 2010

(86) PCT No.: PCT/CN2010/070587

§ 371 (c)(1),
(2), (4) Date: Jul. 9, 2012

(87) PCT Pub. No.: WO2010/094227

PCT Pub. Date: Aug. 26, 2010

(65) Prior Publication Data

US 2013/0000344 A1 Jan. 3, 2013

(30) Foreign Application Priority Data

Feb. 19, 2009 (CN) ..... 2009 1 0105617

(51) Int. Cl.
*F25D 17/00* (2006.01)

(52) U.S. Cl.
USPC ..... 62/333; 62/509

(58) Field of Classification Search
USPC ..... 62/333, 278, 509, 503, 196.1, 513, 512, 62/DIG. 2, 196.3
See application file for complete search history.

(56) References Cited

U.S. PATENT DOCUMENTS 3,600,904 A * 8/1971 Tilney ..... 62/136
3,721,108 A * 3/1973 Kocher ..... 62/470

(Continued)

FOREIGN PATENT DOCUMENTS

CN 2524147 Y 12/2002
CN 2524147 Y 12/2002

(Continued)

OTHER PUBLICATIONS

International Search Report for PCT/CN2010/070578, ISA/CN, Beijing, China, mailed May 6, 2010.

(Continued)

*Primary Examiner* — Mohammad M Ali
(74) *Attorney, Agent, or Firm* — Harness, Dickey & Pierce, P.L.C.

(57) ABSTRACT

An air conditioner is disclosed. The compressor has an entrance coupled to an exit of the evaporator via the first ON/OFF valve; and an exit coupled to an entrance of the condenser via the first flow-direction valve. The liquid pump has an entrance coupled to an exit of the liquid accumulator via the second ON/OFF valve; and an exit coupled to an entrance of the throttling device via the second flow-direction valve. An exit of the condenser is coupled to an entrance of the liquid accumulator; an exit of the throttling device is coupled to an entrance of the evaporator. The compressor's bypass pipe has an entrance coupled to an exit of the evaporator; and an exit coupled to an entrance of the condenser. The liquid pump's bypass pipe has an entrance coupled to an exit of the liquid accumulator; an exit coupled to an entrance of the throttling device.

16 Claims, 4 Drawing Sheets

(56) References Cited

U.S. PATENT DOCUMENTS

| | | | | | |
|---|---|---|---|---|---|
| 5,157,931 | A | * | 10/1992 | Alsenz | 62/116 |
| 5,678,626 | A | * | 10/1997 | Gilles | 165/62 |
| 5,768,903 | A | * | 6/1998 | Sekigami et al. | 62/196.2 |
| 5,878,589 | A | * | 3/1999 | Tanaka et al. | 62/199 |
| 6,145,332 | A | * | 11/2000 | Hyde | 62/190 |
| 6,170,272 | B1 | * | 1/2001 | Backman | 62/117 |
| 7,017,357 | B2 | * | 3/2006 | Brasz | 62/115 |
| 7,484,374 | B2 | * | 2/2009 | Pham et al. | 62/81 |
| 7,536,869 | B2 | * | 5/2009 | Inaba et al. | 62/238.6 |
| 7,647,774 | B2 | * | 1/2010 | Shirk et al. | 60/651 |
| 8,484,984 | B2 | * | 7/2013 | Spearing | 62/99 |
| 2008/0115515 | A1 | | 5/2008 | Bailey et al. | |

FOREIGN PATENT DOCUMENTS

| | | | |
|---|---|---|---|
| CN | 201072192 | Y | 6/2008 |
| CN | 101504222 | A | 8/2009 |
| CN | 101504222 | A | 8/2009 |
| CN | 201463398 | U | 5/2010 |
| JP | 8320161 | A | 12/1996 |
| JP | 10082566 | A | 3/1998 |
| JP | 2000304373 | A | 11/2000 |
| JP | 2001263835 | A | 9/2001 |
| JP | 2006322617 | A | 11/2006 |
| WO | 2008/079119 | A1 | 7/2008 |
| WO | WO-2008079116 | A1 | 7/2008 |

OTHER PUBLICATIONS

First Chinese Office Action regarding Application No. 200910105617.9, dated Sep. 3, 2010. Translation provided by Unitalen Attorneys at Law.

* cited by examiner

AIR CONDITIONER

CROSS-REFERENCE TO RELATED APPLICATIONS

This application is a 371 U.S. National Stage of International Application No. PCT/CN2010/070578, filed Feb. 9, 2010. This application claims priority to Chinese Patent Application No. 200910105617.9, filed Feb. 19, 2009. The disclosures of the above applications are incorporated herein by reference.

FIELD OF THE INVENTION

The present invention relates to an air conditioner.

BACKGROUND OF THE INVENTION

With the development of modern information technology, there are more and more communication equipment rooms in use. Moreover, with the promulgation of policies for energy-saving and emission-reducing of the state, the operators, while developing their business, are trying to reduce the costs, especially the cost for electric power. The air conditioner of the equipment room consumes about half of the total amount of power consumed by the equipment room, and especially, the compressor in the traditional air conditioner system consumes most of the total amount of power consumed by the air conditioner. In this case, it becomes a research direction for air conditioner energy-saving to reduce the operating period of the compressor and thus reduce the electric power consumption.

Due to the great amount of heat emitted by the equipments in the communication equipment room, the air conditioner of the communication equipment room is required to refrigerate all year long. The shortcoming of the traditional air conditioner of equipment room is that the air conditioner is configured according to the outdoor environmental temperature in summer, whereas in winter, spring and autumn when the outdoor environmental temperature is relatively low, it is needed to simulate the operating condition of summer is needed in order to maintain the normal operation of the compressor system; and thus the compressor is required to be operated during the all-year-long operation of the air conditioner. The operating period of the compressor can be reduced if the cold energy outside may be directly released into the equipment room by use of an outdoor cold source, so that the power consumption is reduced.

Currently, there are two ways to perform indoor cooling by use of the outdoor cold source in the refrigerating industry.

The first way is the natural cooling by means of glycol.

An "economizing coil" whose refrigeration capacity is equivalent to an evaporator is added into the indoor unit. The glycol aqueous solution having relatively low temperature in the outdoor unit is pumped into the economizing coil by a water pump located in the indoor unit, and exchanges heat with the warm air in the equipment room, so as to achieve the refrigeration.

The shortcoming of this solution lies in that: a) its application is limited to water-cooling unit; b) due to the economizing coil, the duty of the indoor fan of the equipment room is increased, and thus the total power consumption of the indoor fan in a year is increased, which deteriorates the effect of energy-saving; and c) additional investment is relatively great.

The second way is to directly introduce outdoor fresh air.

The outdoor fresh air is directly introduced to the indoor air-return vent of the equipment room, and fed into the room via a filter screen.

The shortcoming of this solution lies in that: a) the relative humidity of the air fed into the equipment room cannot be controlled easily; b) if the temperature of the fed air is lower than the dew point temperature inside the equipment room, the equipment may has condensed dew thereon; c) although the filter screen is provided, the cleanliness inside the equipment room still cannot be ensured, which may affect the operation of the major equipments and increase the maintaining job of the filter screen; d) it is necessary to excavate the structure under maintenance, which damages the integrity of the building; and e) in a rainy or snowy day water may be fed into the equipment room directly.

SUMMARY OF THE INVENTION

The technical problem to be solved by the present invention is to provide an air conditioner which has a significant energy-saving effect, in order to overcome the above shortcomings.

The technical problem of the present invention is solved by providing an air conditioner, which includes an evaporator, a condenser, a compressor, a liquid pump, and a liquid accumulator, and further includes a first ON/OFF control valve element, a first flow directional control valve element, a second ON/OFF control valve element, a second flow directional control valve element, a throttling device, a liquid pump bypass pipe with a third flow directional control valve element, and a compressor bypass pipe with a fourth flow directional control valve element; wherein an inlet of the compressor is coupled to an outlet of the evaporator via the first ON/OFF control valve element, and an outlet of the compressor is coupled to an inlet of the condenser via the first flow directional control valve element; an inlet of the liquid pump is coupled to an outlet of the liquid accumulator via the second ON/OFF control valve element, and an outlet of the liquid pump is coupled to an inlet of the throttling device via the second flow directional control valve element; an outlet of the condenser is coupled to an inlet of the liquid accumulator, and an outlet of the throttling device is coupled to an inlet of the evaporator; an inlet of the compressor bypass pipe is coupled to the outlet of the evaporator, an outlet of the compressor bypass pipe is coupled to the inlet of the condenser, an inlet of the liquid pump bypass pipe is coupled to the outlet of the liquid accumulator, and an outlet of the liquid pump bypass pipe is coupled to the inlet of the throttling device.

The air conditioner further includes a flow regulating valve for regulating the flow rate of the refrigerant in the liquid pump and a throttling device bypass pipe with a third ON/OFF control valve element, which throttling device bypass pipe is connected at the upstream side and downstream side of the throttling device in parallel.

The first ON/OFF control valve element is a first three-way ON/OFF control valve element, which has an inlet coupled to the outlet of the evaporator and two outlets respectively coupled to the inlet of the compressor bypass pipe and the inlet of the compressor; the second ON/OFF control valve element is a second three-way ON/OFF control valve element, which has an inlet coupled to the outlet of the liquid accumulator and two outlets respectively coupled to the inlet of the liquid pump bypass pipe and the inlet of the liquid pump.

The air conditioner further includes a liquid accumulator bypass pipe which is connected at the upstream side and the downstream side of the liquid accumulator in parallel.

Each of the first ON/OFF control valve element and the second ON/OFF control valve element is a solenoid valve, a stop valve, a ball valve, or an electric ball valve.

Each of the first flow directional control valve element, the second flow directional control valve element, the third flow directional control valve element and the fourth flow directional control valve element is a check valve, a stop valve, a ball valve, or an electric ball valve.

The third ON/OFF control valve element is a solenoid valve, a stop valve, a ball valve, or an electric ball valve.

The air conditioner is used in the communication equipment room.

The advantageous effect of the present invention over the prior art lies in that: due to the facts that the liquid pump consumes far less power than the compressor under the same flow rate, and that the directly introduced outdoor fresh air is avoided, the present invention has a significant energy-saving effect, and it is ensured that the requirement for temperature and humidity control of equipment room and the requirement for indoor cleanliness of equipment room are satisfied. When the compressor system is operating, it is ensured in the present invention that the discharge pressure of the compressor will not acts on the suction lines due to the compressor bypass pipe with the fourth flow directional control valve element, and thus the compressor may be operated normally; and it is ensured that the high-pressure refrigerant will not acts on the liquid pump directly due to the second ON/OFF control valve element arranged upstream of the inlet of the liquid pump and the second flow directional control valve element arranged downstream of the outlet of the liquid pump, and thus the liquid pump can be operated normally for a long term. When the liquid pump system is operating, it is ensured that the refrigerant will not flow into the compressor due to the first ON/OFF control valve element arranged upstream of the inlet of the compressor and the first flow directional control valve element arranged downstream of the outlet of the compressor. The air conditioner according to the present invention is provided with a liquid pump bypass pipe with a third flow directional control valve, so that the liquid pump will not establish a self-circulation therein, and the capacity of the liquid pump is utilized maximally.

In these figures, 1—liquid accumulator; 2—second ON/OFF control valve element; 3—liquid pump; 4—flow regulating valve; 5—second flow directional control valve element; 6—third flow directional control valve element; 7—third ON/OFF control valve element; 8—throttling device; 9—evaporator; 10—first ON/OFF control valve element; 11—compressor; 12—first flow directional control valve element; 13—fourth flow directional control valve element; 14—condenser; 15—liquid accumulator bypass pipe; 16—liquid pump bypass pipe; 17—throttling device bypass pipe; 18—compressor bypass pipe.

DETAILED DESCRIPTION OF THE INVENTION

Hereinafter the present invention will be described in detail by means of particular embodiment with reference to the drawings.

The first embodiment will be described by referring to FIG. 1, which is a schematic view showing the configuration of the first embodiment of the present invention.

Figure 1:
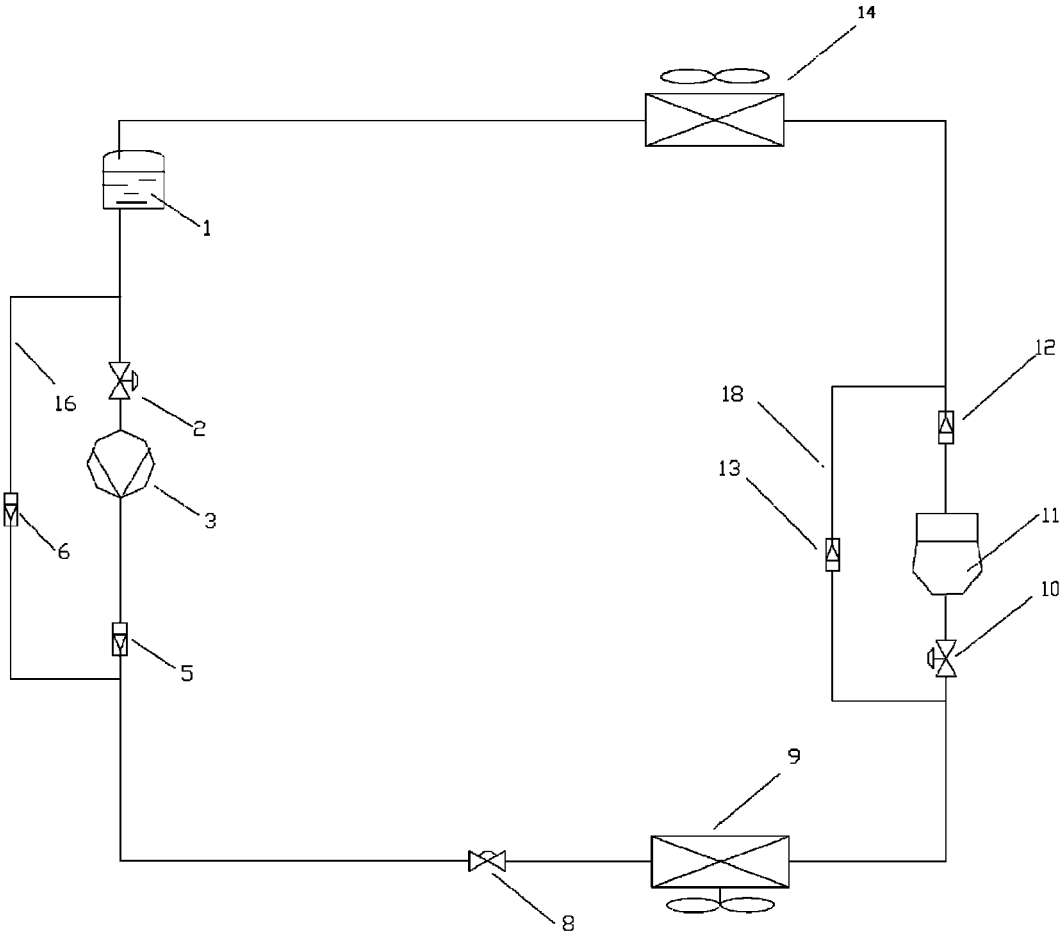
FIG. 1 is a schematic view showing the configuration of the first embodiment of the present invention.

As shown in FIG. 1, the air conditioner according to the first embodiment includes an evaporator 9, a condenser 14, a compressor 11, a liquid pump 3, a liquid accumulator 1, a first ON/OFF control valve element 10, a first flow directional control valve element 12, a second ON/OFF control valve element 2, a second flow directional control valve element 5, a throttling device 8, a liquid pump bypass pipe 16 with a third flow directional control valve element 6, and a compressor bypass pipe 18 with a fourth flow directional control valve element 13.

The respective first ON/OFF control valve element 10 and second ON/OFF control valve element 2 may be a solenoid valve, a stop valve, a ball valve or an electric ball valve. The respective first flow directional control valve element 12, second flow directional control valve element 5, third flow directional control valve element 6, and fourth flow directional control valve element 13 may be a check valve, a stop valve, a ball valve or an electric ball valve.

The compressor 11 serves to compress low-temperature and low-pressure refrigerant vapor into high-temperature and high-pressure refrigerant vapor. The liquid pump 3 serves to transport liquid refrigerant and can operate steadily at high operation pressure without leaking. The liquid pump 3 may particularly be a magnetic driving industrial liquid pump or a canned-motor pump. The condenser 14 serves to remove the heat from the gaseous refrigerant to liquefy the refrigerant, while evaporator 9 serves to gasify the liquid refrigerant by absorbing the heat. The throttling device 8 serves to control the flow rate of the refrigerant. The throttling device 8 executes flow rate control logic for compressor system when the compressor 11 is operating, and executes flow rate control logic for liquid pump system when the liquid pump 3 is operating. The throttling device 8 may be particularly an electronic expansion valve or any other throttling means that has an opening-adjusting function. Liquid accumulator 1 serves to store a certain amount of refrigerant so as to ensure that there is adequate liquid supply when the liquid pump 3 is operating. The first ON/OFF control valve element 10 and the second ON/OFF control valve element 2 serve to switch between the liquid pump 3 system and the compressor 11 system. The first flow directional control valve element 12, the second flow directional control valve element 5, the third flow directional control valve element 6 and the fourth flow directional control valve element 13 serve to control the flow direction of the refrigerant. The refrigerant may particularly be Freon.

The inlet of the compressor 11 is coupled to the outlet of the evaporator 9 via the first ON/OFF control valve element 10, and the outlet of the compressor 11 is coupled to the inlet of the condenser 14 via the first flow directional control valve element 12; the inlet of the liquid pump 3 is coupled to the outlet of the liquid accumulator 1 via the second ON/OFF control valve element 2, and the outlet of the liquid pump 3 is coupled to the inlet of the throttling device 8 via the second flow directional control valve element 5; the outlet of the condenser 14 is coupled to the inlet of the liquid accumulator 1, and the outlet of the throttling device 8 is coupled to the inlet of the evaporator 9; the inlet of the compressor bypass pipe 18 is coupled to the outlet of the evaporator 9, the outlet of the compressor bypass pipe 18 is coupled to the inlet of the condenser 14, the inlet of the liquid pump bypass pipe 16 is coupled to the outlet of the liquid accumulator 1, and the outlet of the liquid pump bypass pipe 16 is coupled to the inlet of the throttling device 8.

The second ON/OFF control valve element 2 is opened when the liquid pump system is operating, and the first ON/OFF control valve element 10 is closed when the liquid pump system is operating, so as to prevent the liquid refrigerant from flowing into the compressor 11. The second ON/OFF control valve element 2 is closed when the compressor system is operating, so as to prevent the high-pressure refrigerant, which is presented when the compressor is operating, from acting on the liquid pump 3 and thus damaging the liquid pump 3. The first ON/OFF control valve element 10 is opened when the compressor system is operating.

The first flow directional control valve element 12 serves to prevent the refrigerant from flowing back into the compressor 11 when the liquid pump system is operating; and the fourth flow directional control valve element 13 serves to prevent the high-pressure gas, which is discharged from the outlet of the compressor when the compressor 11 system is operating, from directly flowing back into the inlet of the compressor via the compressor bypass pipe 18 and thus damaging the compressor. The second flow directional control valve element 5 serves to prevent the high pressure from acting on the liquid pump 3 when the compressor system is operating; and the third flow directional control valve element 6 serves to prevent the liquid refrigerant, which is discharged from the liquid pump when the liquid pump system is operating, from flowing back into the liquid pump via the liquid pump bypass pipe 16.

The operating principle of the air conditioner according to the first embodiment of the present invention is as follows:

When the compressor system is operating, the refrigerant discharged from the outlet of the compressor 11 flows through the first flow directional control valve element 12, the condenser 14, the liquid accumulator 1, the liquid pump bypass pipe 16, the third flow directional control valve element 6, the throttling device 8, the evaporator 9 and the first ON/OFF control valve element 10, and flows back into the compressor 11 to complete a cycle.

When the liquid pump system is operating, the refrigerant discharged from the outlet of the liquid pump 3 flows through the second flow directional control valve element 5, the throttling device 8, the evaporator 9, the compressor bypass pipe 18, the fourth flow directional control valve element 13, the condenser 14, the liquid accumulator 1 and the second ON/OFF control valve element 2, and flows back into the liquid pump 3 to complete a cycle.

The outlet of the liquid accumulator 1 should be disposed higher than the inlet of the liquid pump 3, and the height H of the liquid accumulator 1 may be calculated by an expression: $H>(NPSH+L\times R+Z)/r$, wherein "r" represents the density of the refrigerant in the liquid accumulator 1, "NPSH" represents the net positive suction head of the liquid pump 3, "L" represents the length of the pipeline between the outlet of the liquid accumulator 1 and the inlet of the liquid pump 3, "R" represents the frictional resistance per unit length of the pipeline between the outlet of the liquid accumulator 1 and the inlet of the liquid pump 3, and "Z" represents the minor losses between the outlet of the liquid accumulator 1 and the inlet of the liquid pump 3. In this say, it is ensured that the liquid refrigerant has a certain supercooling degree before it flows into the liquid pump 3, and thus the liquid pump 3 may be operated steadily.

With the same flow rate, the liquid pump 3 consumes far less power than the compressor 11. For example, for a refrigeration unit with a refrigerating capacity of 20 kW, with the same flow rate, the liquid pump 3 will consume less than 10% of the power that would be otherwise consumed by the compressor 11. For a refrigeration unit with a higher refrigerating capacity, the difference between the power consumed by the liquid pump and the power consumed by the compressor would be greater. Therefore, the energy-saving effect of the present invention is significant. In the present invention, the compressor system and the liquid pump system share the condenser and the evaporator, and thus the cost is reduced. Moreover, since the present invention does not introduce outdoor fresh air into the equipment room directly, the temperature, humidity, and cleanliness in the equipment room can be easily controlled, and thus the present invention may meet the requirement for indoor cleanliness of equipment room.

The second embodiment will be described by referring to FIG. 2, which is a schematic view showing the configuration of the second embodiment of the present invention.

Figure 2:
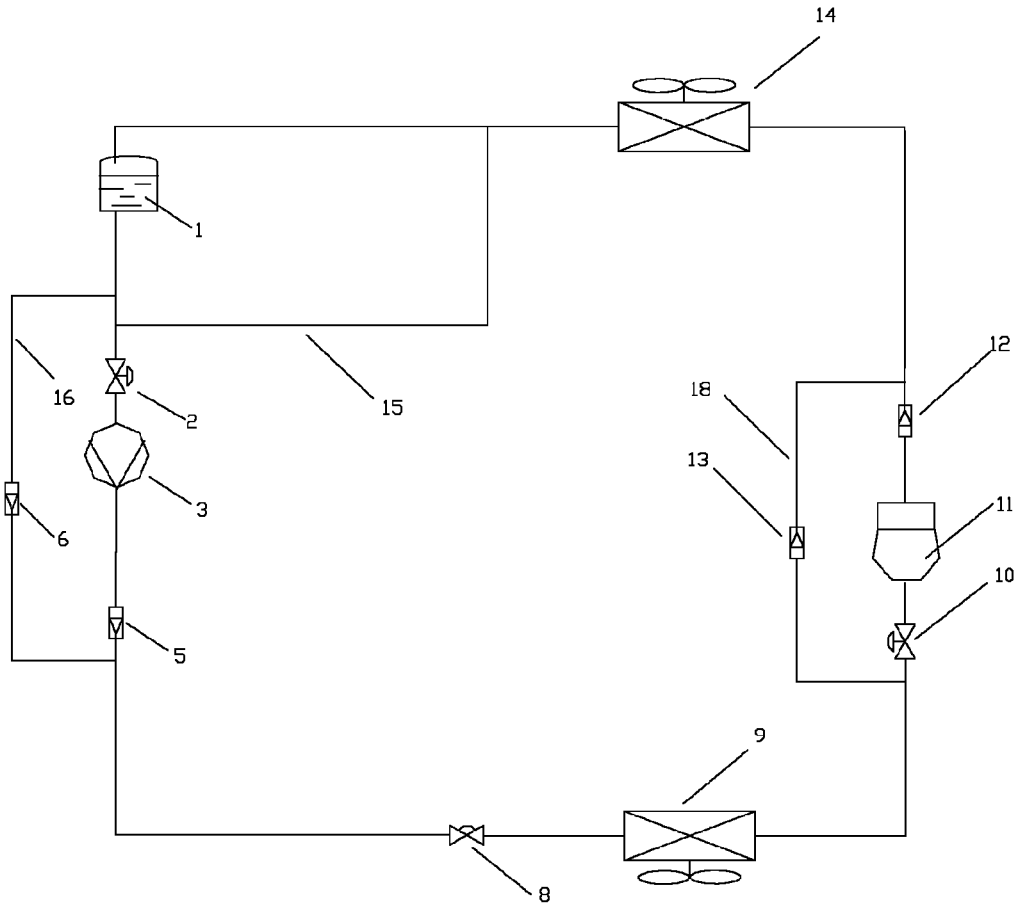
FIG. 2 is a schematic view showing the configuration of the second embodiment of the present invention.

As shown in FIG. 2, the air conditioner according to the second embodiment of the present invention is different from the air conditioner according to the first embodiment in that: the air conditioner according to the second embodiment of the present invention further comprises a liquid accumulator bypass pipe 15, which is connected at the upstream side and downstream side of the liquid accumulator 1 in parallel. As shown in FIG. 2, for example, the inlet of the liquid accumulator bypass pipe 15 is coupled to the outlet of the condenser 14, and the outlet of the liquid accumulator bypass pipe 15 is coupled to the inlet of the second ON/OFF control valve element 2, wherein the outlet of the liquid accumulator bypass pipe 15 is located downstream of the joint of the inlet of the liquid pump bypass pipe 16 and the inlet of the second ON/OFF control valve element 2. Alternatively, the outlet of the liquid accumulator bypass pipe 15 may be located upstream of the joint of the inlet of the liquid pump bypass pipe 16 and the inlet of the second ON/OFF control valve element 2 (this case is not shown in FIG. 2).

The operating principle of the air conditioner according to the second embodiment of the present invention is different from that according to the first embodiment in that: when the liquid pump system is operating, a part of the refrigerant discharged from the condenser 14 flows through the liquid accumulator 1, and the rest part flows through the liquid accumulator bypass pipe 15, and then these two parts of the refrigerant are mixed upstream of the second ON/OFF control valve element 2 and flow back into the liquid pump 3 to complete a cycle. In the air conditioner according to the second embodiment of the present invention, a part of the low-temperature refrigerant discharged from the condenser 14 is led through the liquid accumulator bypass pipe 15 so as to increase the supercooling degree at the inlet of the liquid pump 3, and thus a steady operation of the liquid pump 3 is maintained, cavitation erosion is suppressed, and damage to the liquid pump 3 is prevented.

The third embodiment will be described by referring to FIG. 3, which is a schematic view showing the configuration of the third embodiment of the present invention.

Figure 3:
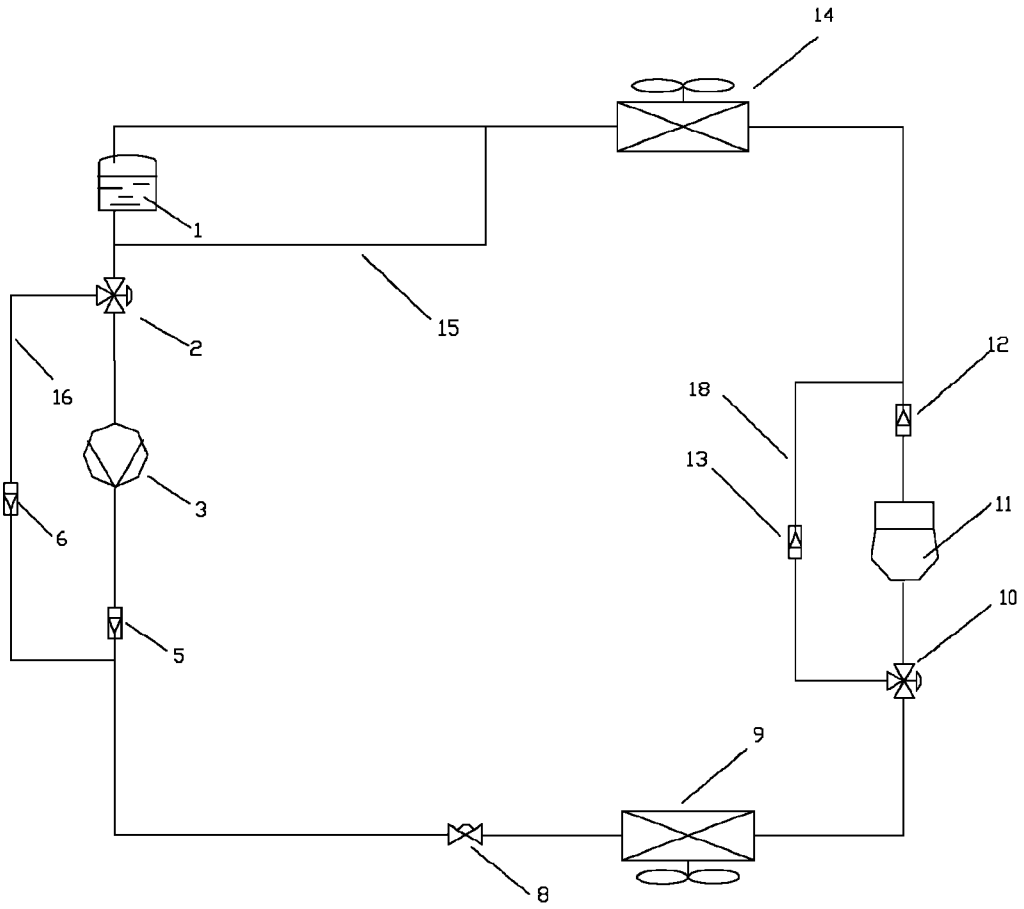
FIG. 3 is a schematic view showing the configuration of the third embodiment of the present invention.

As shown in FIG. 3, the air conditioner according to the third embodiment of the present invention is different from that according to the second embodiment in that: in the third embodiment of the present invention, the first ON/OFF control valve element 10 is a first three-way ON/OFF control valve element, which has an inlet coupled to the outlet of the evaporator 9, and two outlets respectively coupled to the inlet of the compressor bypass pipe 18 and the inlet of the compressor 11; the second ON/OFF control valve element 2 is a second three-way ON/OFF control valve element, which has an inlet coupled to the outlet of the liquid accumulator 1, and two outlets respectively coupled to the inlet of the liquid pump bypass pipe 16 and the inlet of the liquid pump 3.

The operating principle of the air conditioner according to the third embodiment of the present invention is as follows: when the compressor system is operating, the refrigerant discharged from the outlet of the compressor 11 flows through the first flow directional control valve element 12 and the condenser 14; a part of the refrigerant discharged from the condenser 14 flows through the liquid accumulator 1, and the rest part flows through the liquid accumulator bypass pipe 15, and then these two parts of the refrigerant are mixed upstream of the second three-way ON/OFF control valve element and flow through the second three-way ON/OFF control valve element, the liquid pump bypass pipe 16, the third flow directional control valve element 6, the throttling device 8, the evaporator 9 and the first three-way ON/OFF control valve element, and then flow back into the compressor 11 to complete a cycle.

When the liquid pump system is operating, the refrigerant discharged from the outlet of the liquid pump 3 flows through the second flow directional control valve element 5, the throttling device 8, the evaporator 9, the first three-way ON/OFF control valve element, the compressor bypass pipe 18, the fourth flow directional control valve element 13, and the condenser 14; then a part of the refrigerant discharged from the condenser 14 flows through the liquid accumulator 1, and the rest part flows through the liquid accumulator bypass pipe 15, and then these two parts of the refrigerant are mixed upstream of the second three-way ON/OFF control valve element and flow through the second three-way ON/OFF control valve element, and then flow back into the liquid pump 3 to complete a cycle.

The fourth embodiment will be described by referring to FIG. 4, which is a schematic view showing the configuration of the fourth embodiment of the present invention.

Figure 4:
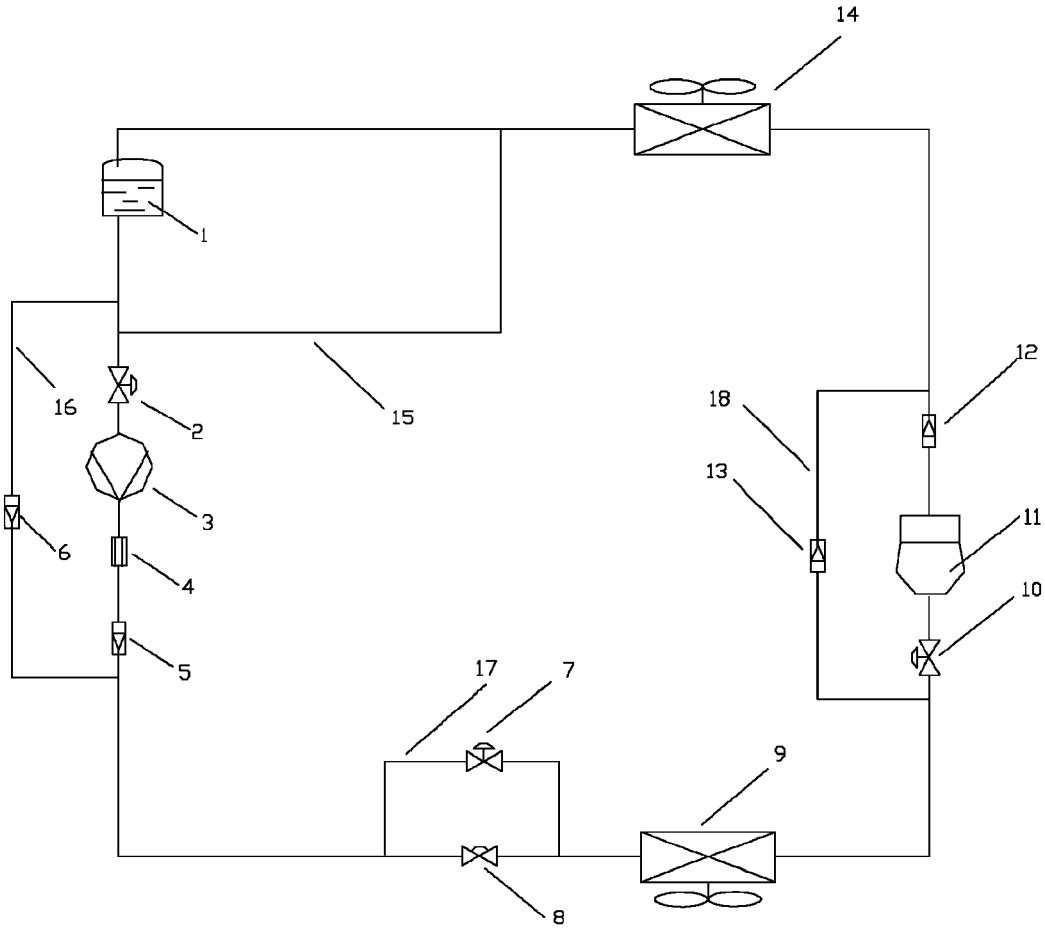
FIG. 4 is a schematic view showing the configuration of the fourth embodiment of the present invention.

As shown in FIG. 4, the air conditioner according to the fourth embodiment of the present invention is different from that according to the second embodiment in that: the air conditioner according to the fourth embodiment further comprises a flow regulating valve 4 for regulating the flow rate of the refrigerant in the liquid pump 3. In FIG. 4, the flow regulating valve 4 may be arranged between the outlet of the liquid pump 3 and the second flow directional control valve element 5. And of course the flow regulating valve 4 may be arranged between the inlet of the liquid pump 3 and the second ON/OFF control valve element 2, between the second flow directional control valve element 5 and the outlet of the liquid pump bypass pipe 16, or between the inlet of the liquid pump bypass pipe 16 and the second ON/OFF control valve element 2. The flow regulating valve 4 may be a constant flow valve, an electronic expansion valve or the like.

The air conditioner according to the fourth embodiment further comprises a throttling device bypass pipe 17 with a third ON/OFF control valve element 7. The throttling device 8 may be a thermostatic expansion valve, an electronic expansion valve, a capillary or the like. The throttling device bypass pipe 17 is connected at the upstream side and downstream side of the throttling device 8 in parallel. The third ON/OFF control valve element 7 is closed when the compressor system is operating, so as to prevent the refrigerant from flowing directly into the evaporator 9 via the throttling device bypass pipe 17. The third ON/OFF control valve element 7 is opened when the liquid pump system is operating.

The operating principle of the air conditioner according to the fourth embodiment of the present invention is as follows:

When the compressor system is operating, the vapor at high-temperature and high-pressure discharged from the outlet of the compressor 11 flows through the first flow directional control valve element 12 and into the condenser 14 where it is condensed and liquefied, and then the refrigerant liquid at high-temperature and high-pressure enters the liquid accumulator 1; the liquid discharged from the liquid accumulator 1 flows in order through the liquid pump bypass pipe 16, the third flow directional control valve element 6, and the throttling device 8 where the pressure of the liquid is reduced and the flow rate of the liquid is throttled; and then the throttled refrigerant liquid at low temperature and low pressure is evaporated and gasified in the evaporator 9, then the refrigerant vapor at low temperature and low pressure flows through the first ON/OFF control valve element 10 back into the compressor 11 to complete a cycle.

When the liquid pump system is operating, the refrigerant pumped from the liquid pump 3 is first regulated in the flow rate by the flow regulating valve 4, and then flows through the second flow directional control valve element 5, the throttling device bypass pipe 17, the third ON/OFF control valve element 7, and into the evaporator 9 where it is evaporated; the refrigerant in vapor phase or in two phases discharged from the evaporator 9 flows through the compressor bypass pipe 18 and the fourth flow directional control valve element 13 into the condenser 14 where it is condensed; a part of the liquid refrigerant discharged from the condenser 14 flows through the liquid accumulator bypass pipe 15, and the rest part flows through the liquid accumulator 1, and then these two parts of the liquid refrigerant respectively discharged from the liquid accumulator 1 and from the liquid accumulator bypass pipe 15 are mixed upstream of the inlet of the second ON/OFF control valve element 2, and then flows through the second ON/OFF control valve element 2 into the liquid pump 3 to complete a cycle.

The air conditioner according to the embodiments of the present invention described above is preferably used in a communication equipment room.

The content described above is a detailed illustration of the present invention with reference to specific preferred embodiment, which is not intended to be construed in any way as limiting embodiments of the present invention. Those skilled in the art may perform modification or replacement without departing from the spirit of the present invention, which are all deemed to fall within the protection scope of the present invention.

The invention claimed is:

1. An air conditioner, comprising an evaporator, a condenser, a compressor, a liquid pump, a liquid accumulator, a first ON/OFF control valve element, a first flow directional control valve element, a second ON/OFF control valve element, a second flow directional control valve element, a throttling device, a liquid pump bypass pipe with a third flow directional control valve element, and a compressor bypass pipe with a fourth flow directional control valve element;

wherein an inlet of the compressor is coupled to an outlet of the evaporator via the first ON/OFF control valve element, and an outlet of the compressor is coupled to an inlet of the condenser via the first flow directional control valve element;

wherein an inlet of the liquid pump is coupled to an outlet of the liquid accumulator via the second ON/OFF control valve element, and an outlet of the liquid pump is coupled to an inlet of the throttling device via the second flow directional control valve element;

wherein an outlet of the condenser is coupled to an inlet of the liquid accumulator, and an outlet of the throttling device is coupled to an inlet of the evaporator;

wherein an inlet of the compressor bypass pipe is coupled to the outlet of the evaporator, an outlet of the compressor bypass pipe is coupled to the inlet of the condenser, an inlet of the liquid pump bypass pipe is coupled to the outlet of the liquid accumulator, and an outlet of the liquid pump bypass pipe is coupled to the inlet of the throttling device.

2. The air conditioner according to claim 1, wherein the air conditioner further comprises a flow regulating valve for regulating flow rate of refrigerant in the liquid pump and a throttling device bypass pipe with a third ON/OFF control valve element, which throttling device bypass pipe is connected at an upstream side and a downstream side of the throttling device in parallel.

3. The air conditioner according to claim 1, wherein the first ON/OFF control valve element is a first three-way ON/OFF control valve element, which has an inlet coupled to the outlet of the evaporator and two outlets respectively coupled to the inlet of the compressor bypass pipe and the inlet of the compressor;

the second ON/OFF control valve element is a second three-way ON/OFF control valve element, which has an inlet coupled to the outlet of the liquid accumulator and two outlets respectively coupled to the inlet of the liquid pump bypass pipe and the inlet of the liquid pump.

4. The air conditioner according to claim 1, wherein the air conditioner further comprises a liquid accumulator bypass pipe which is connected at an upstream side and a downstream side of the liquid accumulator in parallel.

5. The air conditioner according to claim 1, wherein each of the first ON/OFF control valve element and the second ON/OFF control valve element is a solenoid valve, a stop valve, a ball valve, or an electric ball valve.

6. The air conditioner according to claim 1, wherein each of the first flow directional control valve element, the second flow directional control valve element, the third flow directional control valve element and fourth flow directional control valve element is a check valve, a stop valve, a ball valve, or an electric ball valve.

7. The air conditioner according to claim 2, wherein the third ON/OFF control valve element is a solenoid valve, a stop valve, a ball valve, or an electric ball valve.

8. The air conditioner according to claim 1, wherein the air conditioner is used in a communication equipment room.

9. The air conditioner according to claim 2, wherein the air conditioner further comprises a liquid accumulator bypass pipe which is connected at an upstream side and a downstream side of the liquid accumulator in parallel.

10. The air conditioner according to claim 3, wherein the air conditioner further comprises a liquid accumulator bypass pipe which is connected at an upstream side and a downstream side of the liquid accumulator in parallel.

11. The air conditioner according to claim 2, wherein each of the first ON/OFF control valve element and the second ON/OFF control valve element is a solenoid valve, a stop valve, a ball valve, or an electric ball valve.

12. The air conditioner according to claim 3, wherein each of the first ON/OFF control valve element and the second ON/OFF control valve element is a solenoid valve, a stop valve, a ball valve, or an electric ball valve.

13. The air conditioner according to claim 2, wherein each of the first flow directional control valve element, the second flow directional control valve element, the third flow directional control valve element and fourth flow directional control valve element is a check valve, a stop valve, a ball valve, or an electric ball valve.

14. The air conditioner according to claim 3, wherein each of the first flow directional control valve element, the second flow directional control valve element, the third flow directional control valve element and fourth flow directional control valve element is a check valve, a stop valve, a ball valve, or an electric ball valve.

15. The air conditioner according to claim 2, wherein the air conditioner is used in a communication equipment room.

16. The air conditioner according to claim 3, wherein the air conditioner is used in a communication equipment room.

* * * * *

UNITED STATES PATENT AND TRADEMARK OFFICE

CERTIFICATE OF CORRECTION

PATENT NO. : 8,650,898 B2
APPLICATION NO. : 13/201134
DATED : February 18, 2014
INVENTOR(S) : Ma et al.

It is certified that error appears in the above-identified patent and that said Letters Patent is hereby corrected as shown below:

On the Title Page, Item [86] PCT: "PCT/CN2010/070587" should read --PCT/CN2010/070578--.

In the Specification:

Column 5, line 58, Delete "say," and insert --way,--.

In the Claims:

Column 8, line 45, Claim 1, after "comprising", insert --:--.

Signed and Sealed this
Twelfth Day of August, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,650,898 B2
APPLICATION NO. : 13/201134
DATED : February 18, 2014
INVENTOR(S) : Ma et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 300 days.

Signed and Sealed this
Twenty-ninth Day of September, 2015

Michelle K. Lee

Michelle K. Lee
*Director of the United States Patent and Trademark Office*